United States Patent [19]

Morin et al.

[11] 4,224,822

[45] Sep. 30, 1980

[54] DEVICE FOR MEASURING THE COMPACTNESS OF CIGARETTES OR THE LIKE

[75] Inventors: Michel Morin; Alain Rousseau, both of Orleans, France

[73] Assignee: Service d'Exploitation Industrielle des Tabacs et des Allumettes, Paris, France

[21] Appl. No.: 52,508

[22] Filed: Jun. 27, 1979

[30] Foreign Application Priority Data

Jul. 13, 1978 [FR] France ..... 78 20929

[51] Int. Cl.[2] ..... G01N 3/42; A24C 5/32

[52] U.S. Cl. ..... 73/81; 73/819; 131/21 R

[58] Field of Search ..... 73/78, 81, 813, 818, 73/819; 131/21 R

[56] References Cited

U.S. PATENT DOCUMENTS 2,338,070 12/1943 Lopez ..... 73/81

*Primary Examiner*—James J. Gill

*Attorney, Agent, or Firm*—Holman & Stern

[57] ABSTRACT

A device for measuring the compactness of cylindrically shaped smoking articles, such as cigarettes and the like, comprising a supply unit for bringing the articles to a positioning and delivering assembly, two units for measuring the compactness mounted on either side of said assembly, which assembly defines a rectilinear path extending substantially from one measuring unit to the other to allow each article to be moved from a central reception position towards an outermost measuring position, means for positioning the articles when in said reception position alternately in two different angular positions and means for displacing the articles along said path alternately towards one and the other measuring unit.

6 Claims, 4 Drawing Figures

DEVICE FOR MEASURING THE COMPACTNESS OF CIGARETTES OR THE LIKE

The present invention relates to a device for measuring the compactness of cylindrically shaped smoking articles, such as cigarettes, filter cigarettes or filters.

The compactness, or density, of a cigarette or like article characterises its compressibility, hardness, filling. It is one important physical propriety that must be taken into consideration in judging the quality of the article in question. To measure the compactness, a measuring unit is used, comprising jaws which are placed around the cigarette and a predetermined load is applied to one of the jaws. The measurement of the relative displacement of the jaws provides a value representative of the crushing of the cigarette.

The compactness may be assessed in two stages; no-load crushing, under a light pre-load, and crushing under a predetermined load.

Moreover, it has been observed that one measurement of compactness was insufficient and that it was desirable to make two measurements, by applying the load in different directions, particularly in mutually perpendicular directions. As the measurement of compactness is destructive, the measurements are of course carried out with two different cigarettes belonging to the same batch.

It is an object of the invention to provide a device for measuring the compactness of the cigarettes of a batch in two different directions.

There is provided in accordance with the invention a device for measuring the compactness of cylindrically shaped articles for smoking, comprising a supply unit for bringing the articles to a positioning and delivering assembly, two units for measuring the compactness mounted on either side of said assembly, which assembly defines a rectilinear path extending substantially from one measuring unit to the other to allow each article to be moved from a central reception position towards an outermost measuring position, means for positioning the articles when in said reception position alternately in two different angular positions and means for displacing the articles along said path alternately towards one and the other measuring unit.

In view of its structure, the device according to the invention simultaneously measures the compactness in two different positions of the articles, since the two measuring units may function in unison.

Said assembly advantageously comprises at least two drums which define said path therebetween, the drums being rotatable in the same direction so as to cause an article in contact therewith to rotate about its axis.

Each angular position is preferably defined by a light source associated with a detector. It is taken advantage of the fact that the seam of a cigarette is a zone whose reflecting power is different from that of the remainder of the cigarette. When the radiation transmitted by the source impinges on the seam, it is reflected and the output current of the detector is stronger or weaker than outside this position. This detection actuates the instantaneous stopping of the drums on which the cigarette bears.

The invention will be more readily understood on reading the following description with reference to the accompanying drawings, in which.

Figure 1:
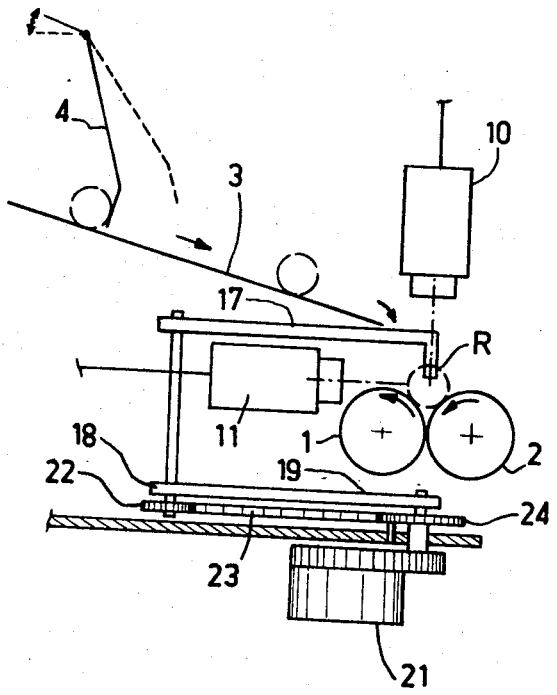
FIG. 1 is a schematic view of the positioning and delivering assembly.
Figure 2:
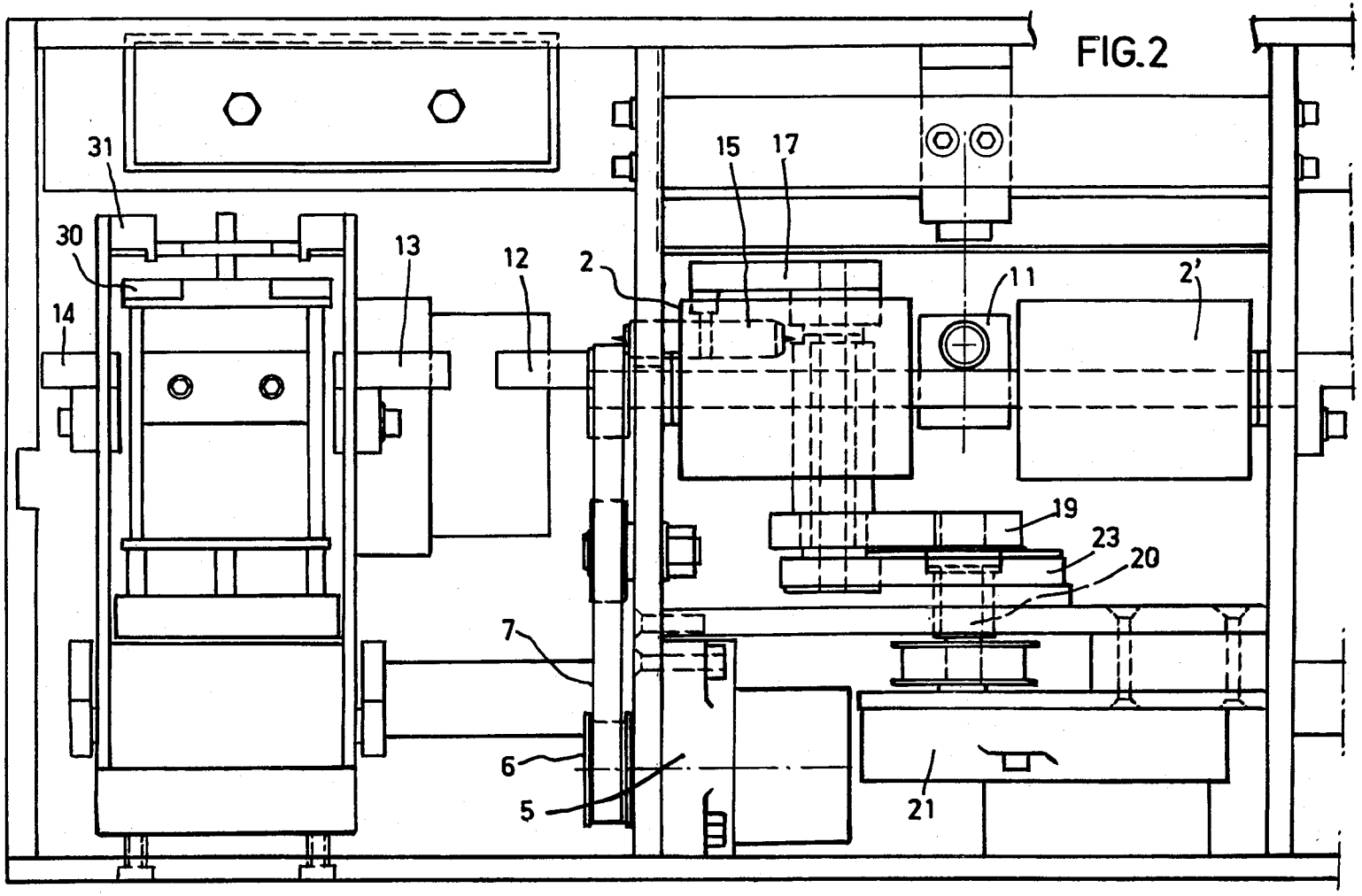
FIG. 2 is a front view of the device according to the invention, one of the measuring units not being shown.

Referring now to the drawings, the device according to the invention for measuring the compactness of cigarettes essentially comprises a supply unit, a positioning and delivering assembly and two measuring units mounted on either side of this assembly.

The device, except for the measuring units, is schematically shown in FIG. 1. It comprises a supply unit for feeding the cigarettes one by one in horizontal position to the central reception position R defined by the drums 1, 1' and 2, 2' and shown in broken lines. The supply unit comprises an inclined plane 3 and a pivotally mounted plate 4 which, in low position, holds the cigarette, orienting it so that its axis is perpendicular to the line of greatest slope of the inclined plane, and in high position (shown in dotted lines), allows said cigarette to move down the inclined plane. The cigarettes are fed one by one on the inclined plane by a feeding member (not shown). The upward pivoting of the plate 4 is actuated electrically in timed relationship with the operation of the device.

The cigarette having left the supply unit assumes the central position mentioned hereinabove to rest on the drums 1, 1' and 2, 2' having parallel axes. The drums 1 and 2 are moved angularly in the same direction so as to rotate the cigarette bearing on the drums by contact. The direction of rotation is illustrated by arrows in FIG. 1. The drums 1 and 2 are driven by a motor 5 via pulleys 6 and a belt 7.

To position the cigarettes correctly, with a view to measuring the compactness, the rotation of the drums must be stopped when the correct position is attained. To detect this, it is taken advantage of the specific reflecting power of the seam of the cigarette. The device comprises a first photo-electric cell 10 placed above the reception zone. When, due to the rotation of the drums 1 and 2, the radiation transmitted by the cell 10 impinges on the seam of the cigarette, the latter reflects this radiation more or less intensely than the remaining surface of the cigarette. The output current produced by the cell takes a higher or lower value than the mean value of the signal, and this enables the seam to be detected. This detection in turn initiates the immediate stopping of the motor 5 and the cigarette keeps the position where the seam is at the top.

Similarly, a second photo-electric cell 11 is placed laterally so that its radiation is transmitted according to an axis at right angles to the axis of cell 10, i.e. an horizontal axis. When this cell 11 is energized, the cigarette therefore takes a position where the seam is on the side.

The cells 10 and 11 are energized in turn, with the result that the cigarettes which assume the reception position are placed alternately with the seam at the top and with the seam on the side. The cigarettes thus positioned are alternately fed towards one and the other measuring unit, so that the compactness measurements are carried out along two perpendicular axes.

The device which achieves the alternate delivering of the cigarettes towards the measuring units will now be described. This delivering is effected along a rectilinear path defined firstly by the drums, then by guides 12, 12' belonging to the delivering assembly, and which extends by supports 13, 14 in each measuring unit.

Delivering is achieved by a push member 15 which reciprocates along said path. This push member 15 is provided with pointed tips 16 for maintaining the cigarettes in the correct position in the course of displacement towards the respective measuring unit. The push member 15 is mounted at the end of an upper arm 17 secured to a pivot 18. The pivot 18 is rotatably mounted on a lower arm 19 of which the other end is rigidly connected to a shaft 20 driven by a gear-down motor 21 comprising motor and reduction gears. Moreover, the pivot 18 carries at its lower end a wheel 22 connected by a notched belt 23 to a wheel 24 mounted around the shaft 20 but rigidly connected to the fixed frame by a pin 25, and therefore fixed.

Figure 3:
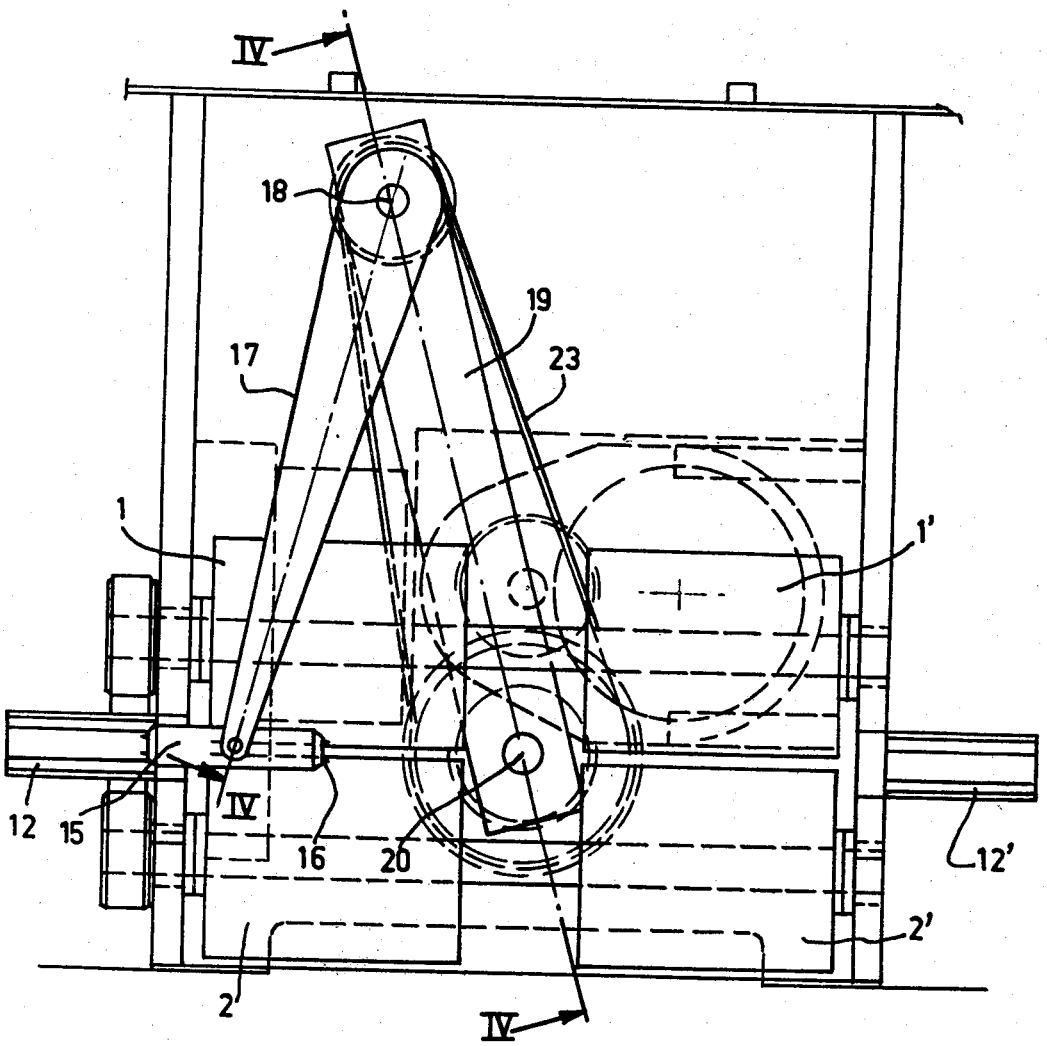
FIG. 3 is a plan view of the positioning and delivering assembly.
Figure 4:
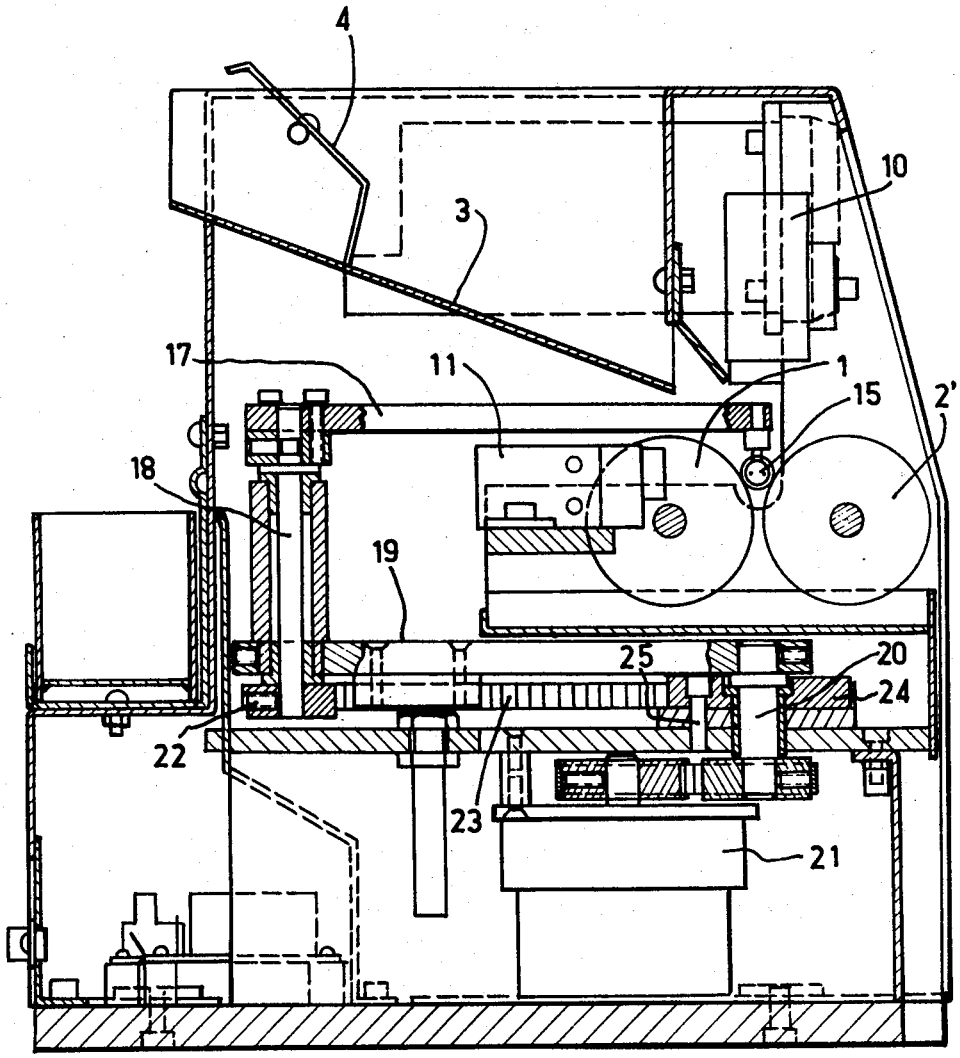
FIG. 4 is a section along line IV—IV of FIG. 3.

As the wheel 24 has a diameter which to twice that of the wheel 22, the mechanism converts the rotational motion of the shaft 20 into a rectilinear motion of the push member 15 along the above-mentioned path. The motor 21 is energized so as to provoke, being assumed that the push member is in the position of FIG. 3, firstly a left-to-right movement of the push member 15, the latter guiding the cigarette present in the reception zone to the right-hand measuring unit, and then, the push member being to the right of the reception zone, a right-to-left movement which brings the following cigarette towards the measuring unit located to the left.

The measuring units do not present any novel features per se. They comprise a lower jaw 29 which accomodates the cigarette and a jaw 30 which is placed on the cigarette to be measured and a mobile part 31 which is applied on the jaw 30 with a predetermined load. The relative displacement of the jaws is indicative of the crushing of the cigarette and consequently of its compactness.

The device described operates as follows. The pivoting plate 4 gives way to a cigarette, which arrives in the reception position. In this position, the cigarette is positioned angularly in suitable manner by means of the drums 1 and 2 and one of the cells 10 and 11. Once this positioning is effected, the push member 15 is displaced to guide the cigarette to the measuring unit located on the side remote from its starting position. During this time, another cigarette has come into engagement with the plate 4. The latter is then pivoted and the second cigarette descends along the inclined plane 3 until it reaches the reception position. In this position, the drums 1 and 2 rotate the cigarette to the correct position, marked by the seam, the energized cell being the one which was not energized for the first cigarette. The push member 15 then moves the cigarette towards the measuring unit not yet supplied. The two measuring units operate in synchronism, one measures the crushing of the cigarette n under load, whilst the other measures the no-load crushing of cigarette n+1; in the following cycle, the first measuring unit determines the no-load crushing of cigarette n+2 whilst the second measures the crushing of cigarette n+1 under load.

Thus, the compactness is measured simultaneously on two cigarettes in two mutually perpendicular directions.

What is claim is:

1. A device for measuring the compactness of cylindrically shaped smoking articles such as cigarettes and the like, comprising a supply unit for bringing the articles to a positioning and delivering assembly, two units for measuring the compactness mounted on either side of said assembly, which assembly defines a rectilinear path extending substantially from one measuring unit to the other to allow each article to be moved from a central reception position towards an outermost measuring position, means for positioning the articles when in said reception position alternately in two different angular positions, and means for displacing the articles along said path alternately towards one and the other measuring unit.

2. A device according to claim 1, wherein said assembly comprises at least two drums which define said path therebetween, the drums being rotatable in the same direction so as to cause an article in contact therewith to rotate about its axis.

3. A device according to claim 1, wherein each of said angular positions is defined by a light source associated with a detector.

4. A device according to claim 2, including a push member liable to move along said path between two outermost positions each corresponding to the introduction of an article in a measuring unit.

5. Device according to claim 4, wherein the push member is provided with pointed tips on its end faces so as to maintain the angular position of the articles during their displacement by said push member.

6. A device according to claim 4, wherein the push member is driven by a motor via a mechanism comprising a shaft driven by the motor, a lower arm secured by one end to this shaft, a pivot rotatably mounted at the other end of said lower arm, an upper arm secured by one end to the pivot and carrying the push member at the other end, a wheel mounted around the shaft and a wheel secured to the pivot and a notched belt connecting both wheels.

* * * * *